US006567113B2

(12) United States Patent
Louis

(10) Patent No.: US 6,567,113 B2
(45) Date of Patent: May 20, 2003

(54) OPENABLE AND LOCKABLE THERMAL PRINTER DEVICE

(75) Inventor: Michel Louis, Gif-sur-Yvette (FR)

(73) Assignee: Axiohm, Montrouge (FR)

( * ) Notice: Subject to any disclaimer, the term of this patent is extended or adjusted under 35 U.S.C. 154(b) by 0 days.

(21) Appl. No.: 10/059,234

(22) Filed: Jan. 31, 2002

(65) Prior Publication Data

US 2003/0058327 A1 Mar. 27, 2003

(30) Foreign Application Priority Data

Sep. 21, 2001 (FR) ..... 01 12200

(51) Int. Cl.[7] ..... B41J 29/00; B41J 29/02
(52) U.S. Cl. ..... 347/222; 347/220
(58) Field of Search ..... 347/222, 220; 400/691, 692, 693

(56) References Cited

U.S. PATENT DOCUMENTS 5,579,043 A * 11/1996 Patry ..... 347/222

* cited by examiner

*Primary Examiner*—Huan H. Tran
(74) *Attorney, Agent, or Firm*—Young & Thompson

(57) ABSTRACT

An opening thermal printer device comprising a stationary frame having a print head provided with a line of heater points and a moving frame that carries a backing roller for paper strip via the ends of an axle, and that moves relative to the stationary frame between a first relative position in which the roller has one of its generator lines in contact with the line of heater points of the head, and a second relative position in which the roller and the head are spaced apart from each other. The print head is fixed to the stationary frame and the device includes a holding mechanism for pressing the roller against the line of heater points when the frames are in the first relative position, the mechanism comprising respective hooks for receiving each of the ends of the axle of the roller, the hooks being slidably mounted on the stationary frame to move in a direction perpendicular to the line of heater points and being subject to the action of respective resilient return members directed towards the print head.

6 Claims, 2 Drawing Sheets

OPENABLE AND LOCKABLE THERMAL PRINTER DEVICE

In the field of printing labels or receipts, it is common practice to use thermal printer devices that print on paper strip having a face that is heat-sensitive.

BACKGROUND OF THE INVENTION

Each label or receipt forming a printed piece of paper is taken from a roll of blank paper which is generally housed in a compartment of the equipment. Access to the compartment for changing the roll takes place via an opening that is closed by a moving wall which carries a portion of the printer, generally the backing (and drive) roller that engages the paper beneath the print head, thereby making it easier to load the roll in the printer and more particularly to put its leader into position.

Various devices exist that implement a printer which opens. Some of them have a print head (in the form of a ceramic plate with a line of heater points) pivotally mounted on a stationary frame and associated with a spring tending to apply return torque to the plate about its pivot axis, urging it towards the backing roller (sometimes referred to as the "capstan"). This return torque makes it possible firstly for the head to retract while the cover carrying it moves in an opening or a closing direction, and secondly for the cover to be locked in the closed state, with the plate bearing against the capstan, holding onto the capstan resiliently and thus holding shut the cover to which the capstan is attached.

The main drawback of such devices lies in the pivot axis of the head and that of the capstan not being exactly parallel because of manufacturing tolerances, wear, etc., which factors cannot be overcome at reasonable cost. When they are not parallel, this leads to pressure on the print head (line of points) against the paper being non-uniform, which in turns leads to print quality varying across the width of the strip of heat-sensitive paper.

OBJECTS AND SUMMARY OF THE INVENTION

The present invention provides a remedy to that drawback by ensuring better positioning between the capstan and the print head at the time of printing, and doing so in a manner that is simple and of low cost, thereby improving the quality of the printing along an entire line of heater points.

The invention thus provides a thermal printer device comprising a stationary frame having a print head provided with a line of heater points and a moving frame that carries a backing roller the paper strip via the ends of an axle and that moves relative to the stationary frame between a first relative position in which the roller has one of its generator lines in contact with the line of heater points of the print head, and a second relative position in which the roller and the print head are spaced apart from each other. In characteristic manner, the print head is fixed to the stationary frame and the device includes a holding mechanism for pressing the roller against the line of heater points when the frames are in the first relative position, the mechanism comprising respective hooks for receiving each of the ends of the axle of the roller, the hooks being slidably mounted on the stationary frame to move in a direction perpendicular to the line of heater points and being subject to the action of respective resilient return members directed towards the print head.

In the invention, by providing a print head that is absolutely stationary in the stationary frame, all uncertainty as to the position of the head relative to that frame is eliminated, where such uncertainty exists by construction in the pivoting heads of the prior art because of manufacturing tolerances for the hinge (frames are generally made of plastics material) and because of play that vary with equipment wear. Then, by providing for the roller (capstan) to be pressed against the line of points by mutually independent hooks at each end of the axle of the roller, the roller is pressed properly and in balanced manner against the line of heater points, unlike previously known devices in which the pressure exerted by the head on the roller forces the roller into support bearings which define the orientation of the roller independently of the orientation of the head.

To enable the hooks to take charge of the roller in this way without stress, and assuming that the moving frame is in the form of a cover hinged to the stationary frame about an axis parallel to the line of heater points, the hinge between the cover and the stationary frame is made to include sufficient play to allow the hooks to compensate for lack of parallelism between the line of points and the hinge of the cover.

In preferred manner, and so as to ensure that the roller has maximum freedom of positioning relative to the moving frame that carries it, each end of the axle of the roller is carried by the moving frame in a slot that is substantially parallel to the sliding direction of the hook when the moving frame is in the above-mentioned first relative position.

In an advantageous embodiment of the device of the invention in which the print head comprises a ceramic plate associated with a metal radiator, the stationary frame is formed by the radiator placed as a spacer between two angle supports each having a sliding guide for a respective one of the hooks extending substantially perpendicularly to the radiator.

This simple structure makes it possible with a minimum number of identical parts to cover an entire range of printer devices that differ only in the width of the strip of paper that is to be printed.

BRIEF DESCRIPTION OF THE DRAWINGS

Other characteristics and advantages of the invention appear from the description given below of an embodiment of the invention.

Reference is made to the accompanying drawings, in which.

MORE DETAILED DESCRIPTION

Figure 1:
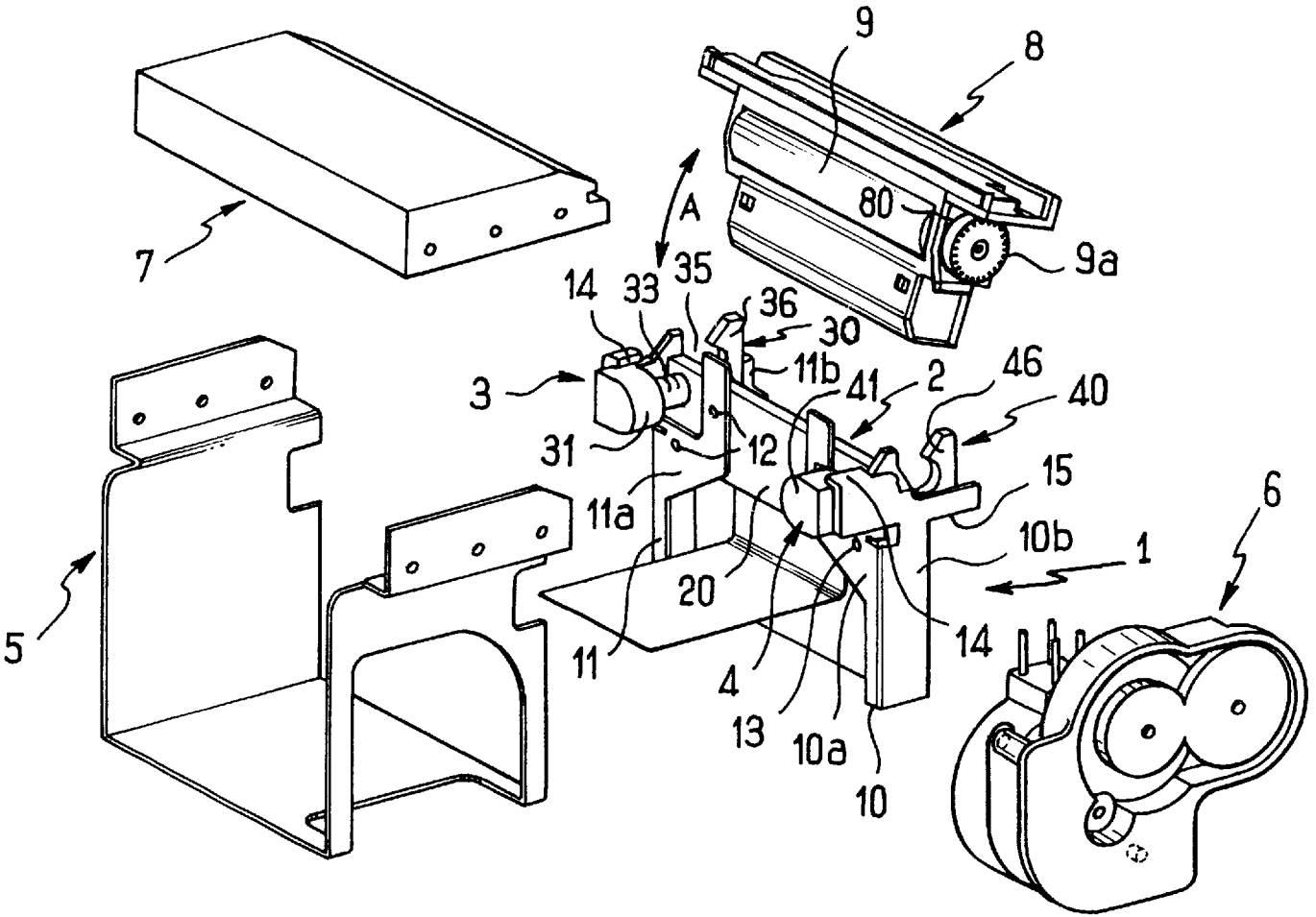
FIG. 1 is a diagrammatic exploded view of the various components of a device in accordance with the invention.

FIG. 1 shows the main components of a thermal printer of the invention. It comprises firstly a frame 1 fitted with a print head 2 and a pair of hooks 3 and 4. The frame 1 is designed to be fixed to the general framework 5 constituting the structure to which a motor and gearbox unit 6 and an element 7 belonging to a device for cutting off printed lengths of paper are also fitted.

The printer also has a frame 8 which rotatably carries a backing and drive roller 9 for the paper that is to be printed. The roller has an axle (not shown in the figure) and it is fitted at one of its ends in conventional manner with a gearwheel 9*a* enabling it to be driven by the motor and gearbox unit 6.

In conventional manner, this equipment is designed to be integrated in some larger structure which defines amongst other things a housing for a roll of heat-sensitive (or "thermal") paper, and an external cover for constituting either a portable appliance for use in smart card transactions, or means for issuing a receipt, a list, or a label, e.g. associated with a payment terminal, with an automatic teller machine (ATM), or with any other transaction.

In general this structure includes a wall that closes access to the compartment for housing the roll of printer paper, which wall can be moved relative to the remainder of the structure and carries the frame 9 referred to herein as the "moving" frame. The remainder of the structure includes the framework 5 having the frame 1 which is referred to herein as the "stationary" frame. Arrow A in FIG. 1 shows the path along which the two frames can move apart and towards each other, the wall carrying the frame 8 being constituted, for example, by a cover hinged to the remainder of the structure about an axis (not shown) parallel to the print head 2.

Figure 2:
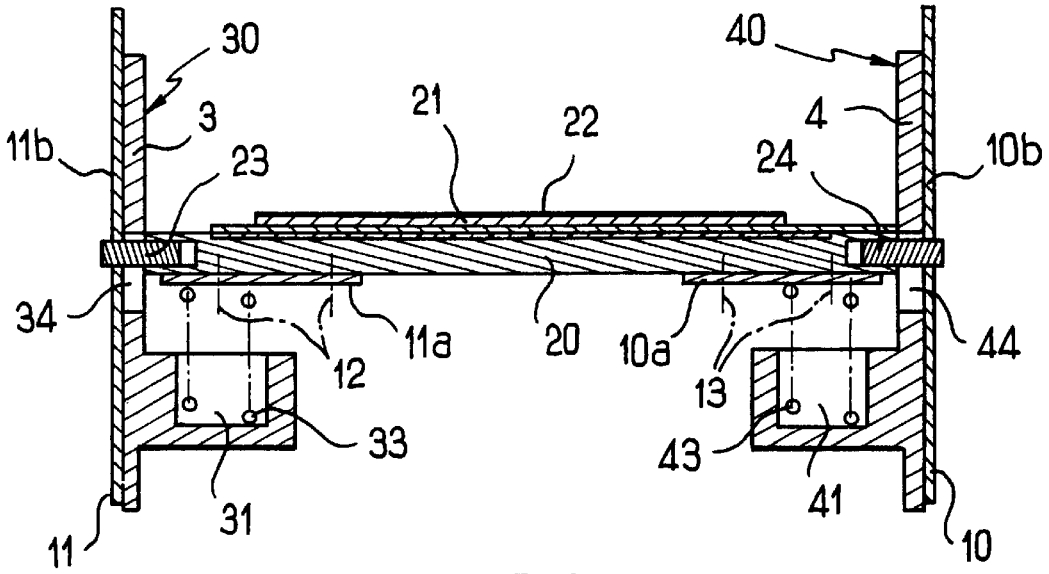
FIG. 2 shows the device of the invention in diagrammatic horizontal section through the stationary frame at hook level.
Figure 3:
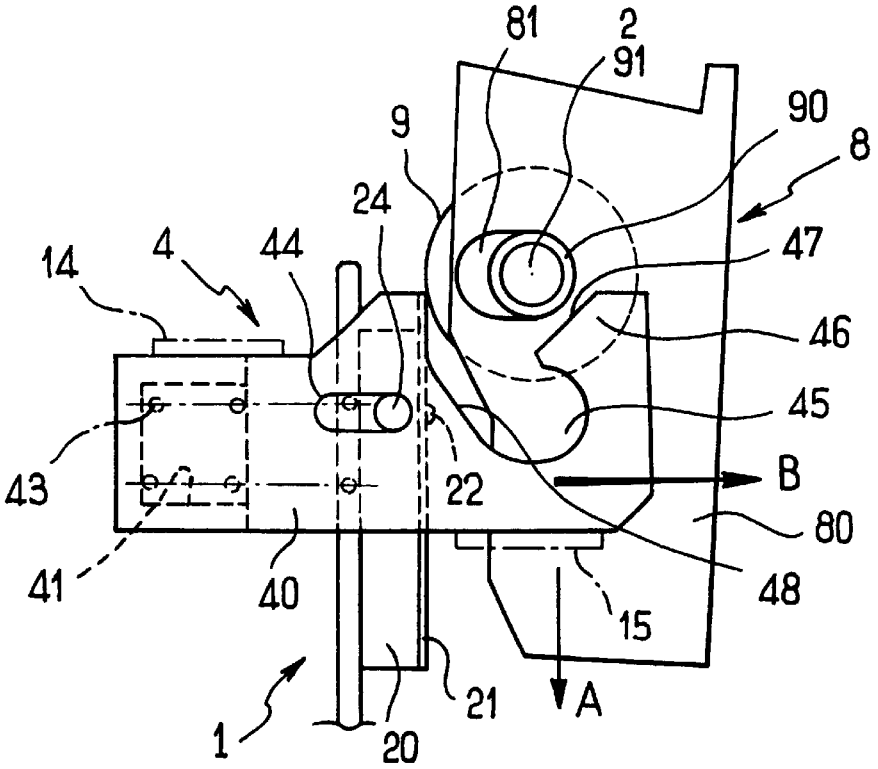
FIG. 3 is a diagram showing how the stationary and moving frames co-operate in the vicinity of their first relative position.

In greater detail, and with reference also to FIGS. 2 and 3, the frame 1 is constituted both by a metal radiator 20 for the print head 2 having fixed therein in conventional manner a ceramic plate 21 carrying a line of heater points 22 together with electrical conductors and electronic components for control purposes, and by two brackets 10 and 11 which are fixed to the radiator 20 by appropriate means 12 and 13 (welding, screws, . . . ).

Each bracket 10, 11 has a tab 10*a*, 11*a* for fixing to the back of the radiator 20 and a crosspiece 10*b*, 11*b* perpendicular to the radiator and spaced apart from the corresponding end thereof by a gap which receives the corresponding hook 3, 4. As shown in FIGS. 2 and 3, each hook is in the form of a cutout plate 30, 40 of thickness substantially equal to the width of the above-mentioned gap and including a respective housing 31, 41 located behind the radiator 20 and overlapping it. Each housing is open towards the radiator and receives a respective spring 33, 43 tending between its own end and the radiator to urge each of the hooks backwards relative to the radiator. Each plate 30, 40 has a slot 34, 44 into which there penetrates a finger 23, 24 secured to the end of the radiator 20 where it faces the corresponding cross-member 10*b*, 11*b*. The fingers and the slots limit sliding of the hooks. They are guided along the cross-members 10*b*, 11*b* of the brackets by means of slideway-forming rims 14, 15.

The portion of each plate 30, 40 situated in front of the print head 2 is cut out to form a hook having an opening 35, 45 defining a free end or tip 36, 46 (see FIG. 3 for the hook 4). A surface 47 on the outside of the tip 46 and inclined relative to the sliding direction of the hook forms an inlet cam for a bearing 90 surrounding the end 91 of the axle of the capstan 9. An inside surface 48 of the hook is also inclined relative to the sliding direction of the hook, but in the opposite direction (naturally the same applies to the hook 3).

It will be seen that the frame 8 carries the capstan 9 by means of partitions 81 between which, in register with the hooks 3 and 4, the axle 91 and its bearings 90 are uncovered so as to allow them to co-operate with the hooks 3 and 4 so as to penetrate into the openings 35, 45. In addition, the partitions 80 hold the axle 91 in slots 81 whose long dimension is substantially perpendicular to the print head 2 when the capstan 9 is in contact with the line of heater points.

When the cover carrying the frame 8 is moved down to close the compartment for the roll of paper, the capstan 9 comes into contact with the print head at the end of the closing movement (arrow A in FIG. 3) and it rolls thereon. In the slot 81, the axle 91 can no longer move towards the left in FIG. 3. The bearing 90 thus comes into contact with the inclined cam surface 47 (and 37 for the hook 3) and continued closure causes the hooks 3 and 4 to move to the right in FIG. 3 (arrow B) thus enabling the bearing 90 of the capstan to penetrate into the opening 45. Once the bearing has gone past the tip 46, each hook is returned against the head 2 by the corresponding spring 33, 43, having the effects firstly of holding the bearing 90 in the bottom of the opening 45 and thus opposing (at least to some extent) any movement of the capstan in the cover-opening direction (direction opposite to arrow A in FIG. 3), and secondly of pressing the capstan against the print head 2, and more precisely against the line of points 22. Since the hooks are independent, the action of each hook on the corresponding end of the axle 91 enables the capstan to be applied in balanced manner against the line of heater points, thus making it possible to accommodate and correct positioning error of said print head, if any. It will be observed that the bearings 90 at the ends of the axle 91 in register with the hooks 3 and 4 have the advantage of opposing practically no resistance to the is capstan 2 rolling on the paper that covers the head 2 when the cover is closed and while the printer is in operation.

The force that needs to be developed in order to separate the frame 8 from the frame 1 depends on the shape of the opening 45 at the tip 46. If this shape is shallow then they can be separated by raising the cover, it being possible to overcome the return force of the hooks merely by applying a lifting force. In contrast, if the opening is deep in shape, then locking is positive and it is necessary to move the hooks 3 and 4 in order to release the axle 91. A pusher can be provided for this purpose, and when the hooks are moved manually away from the print head, surfaces such as the surface 48 in FIG. 3 urge the bearings 90 to go beyond the tip 46, thereby making it easier to unlock the cover. The pusher needs to be capable of acting on both hooks simultaneously, but without that constituting a link between the hooks since it is necessary to preserve their individual actions on the capstan.

In a variant embodiment of the invention (not shown) the axle 91 of the roller 9 is carried in bearings of the frame 8. To be able to benefit nevertheless from the correcting action of the hooks on the orientation of the axle 91 relative to the print head 2, and insofar as the moving frame 8 is carried by a cover which is hinged to a structure which includes the stationary frame 1, play needs to be provided in the hinge whose axis is substantially parallel to the line of heater points.

What is claimed is:

1. An opening thermal printer device comprising a stationary frame having a print head provided with a line of heater points and a moving frame that carries a backing roller for paper strip via the ends of an axle, and that moves relative to the stationary frame between a first relative position in which the roller has one of its generator lines in contact with the line of heater points of the head, and a second relative position in which the roller and the head are spaced apart from each other, wherein the print head is fixed to the stationary frame and wherein the device includes a holding mechanism for pressing the roller against the line of heater points when the frames are in the first relative position, the mechanism comprising respective hooks for receiving each of the ends of the axle of the roller, the hooks being slidably mounted on the stationary frame to move in a direction perpendicular to the line of heater points and being subject to the action of respective resilient return members directed towards the print head.

2. A device according to claim 1, wherein the moving frame is hinged to the stationary frame about an axis that is substantially parallel to the line of heater points, with play.

3. A device according to claim 1, wherein each end of the axle of the roller is carried by the moving frame in a slot substantially parallel to the sliding direction of the hooks when the moving frame is in its above-mentioned first relative position.

4. A device according to claim 1 in which the print head comprises a ceramic plate associated with a metal radiator, wherein the stationary frame is formed by the radiator disposed as a spacer between two bracket supports each having a sliding guide for one of the hooks extending substantially perpendicular to the radiator.

5. A device according to claim 1, wherein the free end of each hook carries on its outside an inlet cam surface for the axle of the roller so as to move the hook away from the radiator while the axle of the roller is going past during the movement of the moving frame from its second relative position towards its first relative position.

6. A device according to claim 1, wherein each hook possesses an inside cam surface for forcing the axle of the roller to become disengaged from the hook when the hook is moved against the force of the return member.

* * * * *